US012426724B2

(12) United States Patent
Rodriguez et al.

(10) Patent No.: US 12,426,724 B2
(45) Date of Patent: Sep. 30, 2025

(54) SOFT CLOSE DEVICE FOR DOORS

(71) Applicant: Anthony, Inc., Sylmar, CA (US)

(72) Inventors: Adrian Rodriguez, Santa Clarita, CA (US); Mark Sandnes, Granada Hills, CA (US)

(73) Assignee: Anthony, Inc., Sylmar (CA)

( * ) Notice: Subject to any disclaimer, the term of this patent is extended or adjusted under 35 U.S.C. 154(b) by 55 days.

(21) Appl. No.: 18/355,566

(22) Filed: Jul. 20, 2023

(65) Prior Publication Data

US 2024/0023728 A1 Jan. 25, 2024

Related U.S. Application Data

(60) Provisional application No. 63/391,019, filed on Jul. 21, 2022.

(51) Int. Cl.
*A47F 3/04* (2006.01)
*F25D 23/08* (2006.01)

(52) U.S. Cl.
CPC ..... *A47F 3/043* (2013.01); *F25D 23/087* (2013.01)

(58) Field of Classification Search
CPC .... F25D 23/028; F25D 23/082; F25D 23/087; F25D 2700/02; A47F 3/0426; A47F 3/043
See application file for complete search history.

(56) References Cited

U.S. PATENT DOCUMENTS 2,807,841 A * 10/1957 Janos ..... F25D 23/087 49/478.1
4,305,182 A * 12/1981 Peterson ..... F25D 23/082 24/297
4,328,273 A * 5/1982 Yackiw ..... E06B 7/2314 428/101
5,309,680 A * 5/1994 Kiel ..... F25D 23/082 49/478.1
5,934,098 A * 8/1999 Lee ..... E05C 19/161 62/298
2008/0209812 A1* 9/2008 Lancry ..... F25D 23/087 49/316
2011/0006652 A1* 1/2011 Veltrop ..... F25D 23/087 277/345
2017/0130522 A1* 5/2017 Lewan ..... F25D 23/028
(Continued)

FOREIGN PATENT DOCUMENTS

CN 101261068 A * 9/2008
CN 205718177 U * 11/2016
(Continued)

*Primary Examiner* — Andrew Roersma
(74) *Attorney, Agent, or Firm* — Fish & Richardson P.C.

(57) ABSTRACT

A soft close device for doors. A display case door includes a gasket and a compressible foam. The gasket has a peripheral body defining a cavity. The peripheral body includes a first portion, a second portion, and a third portion. The first portion is substantially flat and coupled to a surface of the display case door. The second portion is arranged on an opposite side of the cavity to the first portion. The second portion includes a magnet. The third portion is disposed between the first portion and the second portion. The third portion compresses when the door is closed against a cabinet frame. The compressible foam is positioned in and extends along a length of the cavity.

18 Claims, 7 Drawing Sheets

(56) References Cited

U.S. PATENT DOCUMENTS

| | | | | |
|---|---|---|---|---|
| 2017/0261252 | A1* | 9/2017 | Son | F25D 23/028 |
| 2018/0220791 | A1* | 8/2018 | Olson | E05C 3/145 |
| 2018/0299189 | A1* | 10/2018 | Johnson | F16J 15/104 |
| 2019/0050900 | A1 | 2/2019 | Avakian | |
| 2019/0122263 | A1 | 4/2019 | Avakian | |
| 2020/0256612 | A1 | 8/2020 | Avakian et al. | |
| 2020/0300538 | A1 | 9/2020 | Avakian et al. | |
| 2021/0041161 | A1 | 2/2021 | Avakian | |
| 2021/0366005 | A1 | 11/2021 | Avakian et al. | |
| 2022/0003492 | A1* | 1/2022 | Ries | F25D 23/087 |
| 2022/0065521 | A1* | 3/2022 | Shivappa Thenehalli | F25D 11/02 |

FOREIGN PATENT DOCUMENTS

| | | | | | |
|---|---|---|---|---|---|
| CN | 108955049 | A | * | 12/2018 | F25D 23/028 |
| CN | 112378163 | A | * | 2/2021 | |
| DE | 202017107825 | U1 | * | 5/2019 | F25D 23/087 |
| EP | 1170563 | A2 | * | 1/2002 | F25D 23/087 |
| JP | S-6089578 | U | * | 6/1985 | F25D 23/02 |
| JP | H-10292980 | A | * | 11/1998 | |
| JP | 2000130921 | A | * | 5/2000 | F25D 23/02 |
| JP | 2000161842 | A | * | 6/2000 | |
| JP | 2003314953 | A | * | 11/2003 | F25D 23/087 |
| KR | 20150063247 | A | * | 6/2015 | F25D 23/087 |
| KR | 20210087160 | A | * | 7/2021 | |
| WO | WO 2019/032893 | | | 2/2019 | |
| WO | WO 2020/131881 | | | 6/2020 | |
| WO | WO 2021/150406 | | | 7/2021 | |

* cited by examiner

SOFT CLOSE DEVICE FOR DOORS

CROSS-REFERENCE TO RELATED APPLICATION

This application is claims priority under 35 U.S.C. § 119 to U.S. Application No. 63/391,019, filed on Jul. 21, 2022, the contents of which is hereby incorporated by reference.

TECHNICAL FIELD

This disclosure relates to closing a door, in particular, closing a display case door using a soft close device.

BACKGROUND

Display cases are cooled devices for storing foods and beverages. Display cases can have doors which are operated to control access to the contents of the display case. Display case doors can be operated (shut) with force, which can exceed a threshold force. In some cases, when the force operating the display case door exceeds the threshold force, electric components and mechanical components of the display case can be damaged.

SUMMARY

This disclosure describes systems and methods related to reducing a mechanical impact due to closing a display case door. Display cases store foods and beverages in a cooled state. Display cases have doors which can be operated, that is, opened and closed to access the foods and beverages contained in the display cases. Display case doors can be operated (especially closed) with force which can exceed a threshold force. In some cases, when the force closing the display case door exceeds the threshold force, some electric components and mechanical components of the display case can be damaged. This approach closes the display case door with a force below the threshold force to protect some electric components and mechanical components of the display case from damage. While described within the context of display case doors, implementations of doors, impact reducing gaskets, and soft close devices described herein can be installed on different types of enclosures including, but not limited to, refrigerators, freezers, and commercial display cases.

In one aspect, a display case door includes a gasket and a compressible foam. The gasket has a peripheral body defining a cavity. The peripheral body includes a first portion, a second portion, and a third portion. The first portion is substantially flat and coupled to a surface of the display case door. The second portion is arranged on an opposite side of the cavity to the first portion. The second portion has a magnet. The third portion is disposed between the first portion and the second portion. The third portion compresses when the door is closed against a cabinet frame. The compressible foam is positioned in and extends along a length of the cavity.

In some embodiments, the magnet contacts the second portion of the gasket to at least one of a display case door, a display case cabinet frame, or a second display case door gasket.

In some embodiments, the gasket is a first gasket and the magnet is a first magnet. The display case door further includes a second gasket having a second peripheral body defining a second cavity. The second peripheral body has a fourth portion, a fifth portion, and a sixth portion. The fourth portion is substantially flat and coupled to a surface of a display case cabinet frame. The fifth portion is arranged on an opposite side of the second cavity to the fourth portion. The fifth portion has a second magnet. The sixth portion is disposed between the fourth portion and the fifth portion. The sixth portion compresses when the door is closed against a cabinet frame. The second compressible foam is positioned in and extends along a second length of the second cavity. In some cases, the first magnet is positioned to couple to the second magnet.

In some embodiments, a cross section of the compressible foam is at least one of a rectangular shape, a circular shape, a square shape, or a triangular shape.

In some embodiments, a cross section of the compressible foam varies along a length of the compressible foam.

In some embodiments, the compressible foam further includes at least one of a second compressible foam.

In some embodiments, the compressible foam includes a rubber or a plastic.

In some embodiments, a compressibility of the compressible foam varies along a length of the compressible foam.

In some embodiments, the third portion is spring shaped.

In some embodiments, the third portion is accordion shaped.

In some embodiments, compressible foam completely fills the cavity.

In some embodiments, compressible foam fills a majority of a volume within the cavity.

In some embodiments, compressible foam fills a portion of a volume within the cavity.

In some embodiments, the peripheral body completely wraps around the compressible foam.

In another aspect, a display case has a display case cabinet frame, a display case door, and a gasket. The display case door is pivotably coupled to the display case cabinet frame. The gasket is coupled to the display case door. The gasket has a peripheral body defining a cavity. The peripheral body includes a first portion, a second portion, and a third portion. The first portion is substantially flat and coupled to a surface of the display case door. The second portion is arranged on an opposite side of the cavity to the first portion. The second portion has a magnet. The third portion is disposed between the first portion and the second portion. The third portion compresses when the door is closed against a cabinet frame. The compressible foam positioned in and extends along a length of the cavity.

In some embodiments, a compressibility of the compressible foam varies along a length of the compressible foam.

In some embodiments, the peripheral body completely wraps around the compressible foam.

In some embodiments, a portion of the gasket is positioned along a handle opening side of the display case door.

In some embodiments, a portion of the gasket is positioned along a handle opening side, a portion of a top side of the display case door, and a portion of a bottom side of the display case door.

In some embodiments, the gasket is positioned about a border of the display case door.

In some embodiments, a cross section of the gasket varies along a portion of a border of the display case door.

In some embodiments, a border of the display case cabinet frame has at least one of a top side of the display case door, a bottom side of the display case door, a hinge side of the display case door, or a handle opening side of the display case door.

In yet another aspect, a door soft-close device includes a gasket and a compressible foam. The gasket has a peripheral body defining a cavity. The peripheral body includes a region to compress responsive to a force on the gasket. The compressible material is positioned in and extends along a length of the cavity.

In some embodiments, the door soft-close device includes a magnet coupled to the gasket. In some cases, the magnet couples the gasket to a display case.

In some embodiments, a cross section of the compressible material is at least one of a rectangular shape, a circular shape, a square shape, or a triangular shape.

In some embodiments, a cross section of the compressible material varies along a length of the compressible material.

In some embodiments, the compressible material is at least one of a foam, a rubber, or a plastic.

In some embodiments, a compressibility of the compressible material varies along a length of the compressible material.

In some embodiments, the region is spring shaped.

In some embodiments, the region is accordion shaped.

In some embodiments, the compressible material completely fills the cavity.

In some embodiments, the compressible material fills a majority of a volume within the cavity.

In some embodiments, the compressible material fills a portion of a volume within the cavity.

In some embodiments, the peripheral body completely wraps around the compressible material.

In some embodiments, the display case includes one or more sensors and a controller. The one or more sensors sense a position of the gasket relative to a sealing surface. The controller perform operations including: determining a status of the gasket as not being sealed; and controlling an operation of the display case to seal the gasket.

Implementations of the present disclosure can realize one or more of the following advantages. These systems and methods can improve electrical and mechanical component reliability. For example, by reducing the operating force on the display case door, vibration forces and impact forces can be reduced, thereby decreasing wear and the likelihood of damage to electrical and mechanical components of the door and/or the display case. Implementations may therefore improve electrical and mechanical component reliability.

These systems and methods can increase electrical and mechanical operating life. For example, by reducing the operating force on the display case door below the threshold force, damage from vibration forces and impact forces can be reduced; and electrical and mechanical component operating life can be increased.

These systems and methods can improve personnel safety. For example, by reducing the operating force on the display case door below the threshold force, decreasing electrical and mechanical component such as electrical shorts or mechanical breakage which can harm a user can be reduced, improving personnel safety.

These systems and methods can increased display case operating and cooling efficiency. For example, by reducing the operating force on the display case door below the threshold force, decreasing electrical component failure such as a controller failure, electrical connection failure or damage increasing circuit resistance or creating component electrical shorts can increase display case operating and cooling efficiency. For example, by reducing the operating force on the display case door below the threshold force, decreasing mechanical component failures causing a refrigerant leak, a cooled air leak, mechanical breakage, a buildup of ice, or inability to reach safe product temperatures can increase display case operating and cooling efficiency. The soft close gasket can protect sensitive electrical and mechanical components built into displace case door and cabinet frames.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure relates to mechanisms for reducing the mechanical impact of closing a door. This approach includes a "soft-close" gasket designed to reduce mechanical impact when a display case door is closed. In an exemplary implementation, the gasket has a peripheral body which defines a cavity and a compressible foam positioned in, and extending along a length of the cavity. The peripheral body of the gasket has a first portion, a second portion, and a third portion. The first portion is substantially flat and coupled to a surface of the display case door. The second portion has a magnet and is arranged on an opposite side of the cavity to the first portion. The third portion is disposed between the first portion and the second portion to compress when the door is closed against a cabinet frame.

Display cases contain a volume of cooled air at an internal temperature lower than an outer ambient temperature to store items in a cooled state. For example, display cases can store foods and beverages in the cooled state to maintain freshness or shelf life. Display cases have doors which can be operated by a user relative to a cabinet frame of the display case, that is, opened and closed, so the user can access the foods and beverages contained in the display cases. Display case doors can be operated (especially closed) by the user with force which can exceed a threshold force. In some cases, when the force closing the display case door exceeds the threshold force, some electric components and mechanical components of the display case can be damaged. For example, display case door glass can be cracked or shattered, plastic fittings can be cracked or broken, or electronics such as controllers, electronic display screens, or other sensitive components built into display case door and cabinet frames can be damaged. This approach closes the display case door by the gasket relative to the cabinet frame by a force less than a threshold force.

While described within the context of display case doors, implementations of doors and impact reducing gaskets described herein can be installed on different types of enclosures including, but not limited to, refrigerators, freezers, and commercial display cases.

Figure 1:
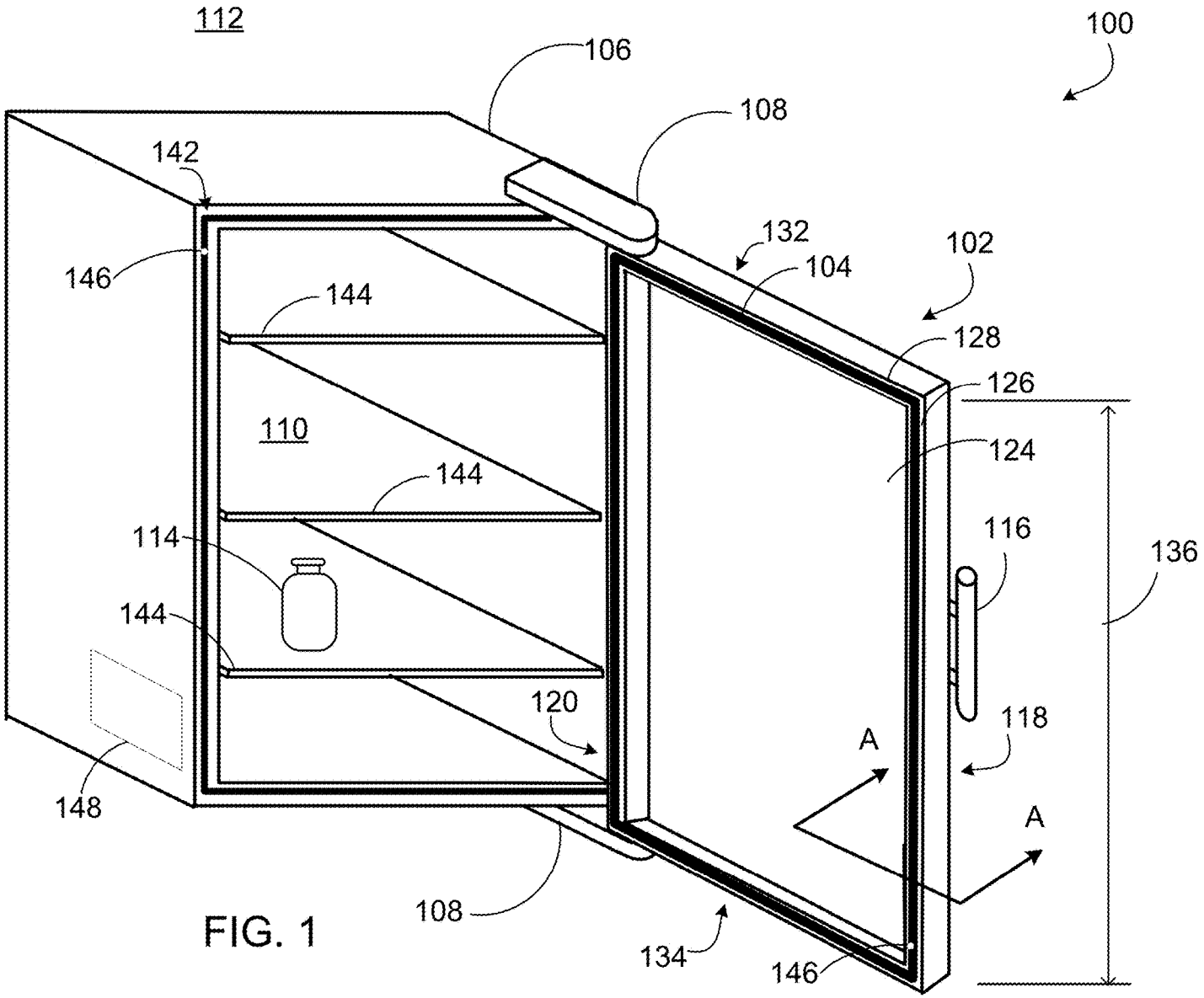
FIG. 1 is a schematic view of an example display case with a gasket according the implementations of the present disclosure.

FIG. 1 is a schematic view of an example display case with a gasket according the implementations of the present disclosure. Referring to FIG. 1, display case 100 has a display case door 102 with a gasket 104 coupled to the display case door 102. The display case door 102 is pivotably coupled to a cabinet frame 106 of the display case 100 by hinges 108. The display case 100 contain a volume 110 of cooled air at an internal temperature lower than an outer environment 112 with air at ambient temperature to store items 114 in a cooled state on shelves 144. The display case door 102 can have a translucent or transparent pane 124 so the user can view the cooled items 114 in the cabinet frame 106 of the display case 100. The display case 102 has electrical and mechanical refrigeration components, not shown, to control the internal temperature of the volume 110 of the display case 100. For example, a refrigeration system with a compressor, a condenser, an evaporator, an expansion device, sensors 146, a controller 148, and other associated components (all not shown) can decrease the internal temperature in the volume 110 of the display case 100.

In some examples, door 102 includes an electronic display mounted thereto. For example, the door 102 can include a video display or video touch screen display mounted to the door 102. In some examples, the video display is mounted over the translucent/transparent pane 124. In such implementations, the door 102 includes electronic controls (not shown), e.g., a media player and network interface for controlling content displayed on the video display.

A handle 116 is mechanically coupled to the display case door 102 on a handle side 118 of the display case door 102. A user (not shown) pulls or pushes on the handle 116 to move the handle side 118 of the display case door 102 farther away or near to, respectively, the display case cabinet frame 106 by pivoting the display case door 102 about the hinges 108 on a hinge side 120 of the display case door 102. In some instances, the user operates the display case door 102 by the handle 116 to shut the display case door 102 to contact the cabinet frame 106 with a force exceeding a threshold force. When the force shutting the display case door 102 exceeds the threshold force, the translucent pane 124, the electronic display screen, the electronic controls, the refrigeration system with the compressor, the condenser, the evaporator, the expansion device, the controller, and other associated components can be damaged.

The gasket 104 is coupled to an inner surface 126 of the display case door 102 and positioned about and internal to an surface 128 of the display case door 102. The gasket 104 can be coupled to the display case door by a press fit into a groove (not shown) on the inner surface 126 of the display case door 102, by an adhesive (not shown), or fastened by a fastener (not shown). The gasket 104 can be coupled to the handle side 118, the hinge side 118, a top side 132, and a bottom side 134 of the display case door 102. The inner surface 126 can be a border of the display case door 102. The gasket 104 extends along a length 136 of the display case door 102. The length 136 can correspond to a portion 138 of the handle side 118. The length 136 can correspond to the entire handle side 118. The length 136 can correspond to the entire handle side 118 and portions 140 of each of the top side 132 and bottom side 134. The length 136 can correspond to the entire handle side 118, the top side 132, and the bottom side 134. The length 136 can correspond to the entire handle side 118, the hinge side 118, the top side 132, and the bottom side 134.

Figure 2:
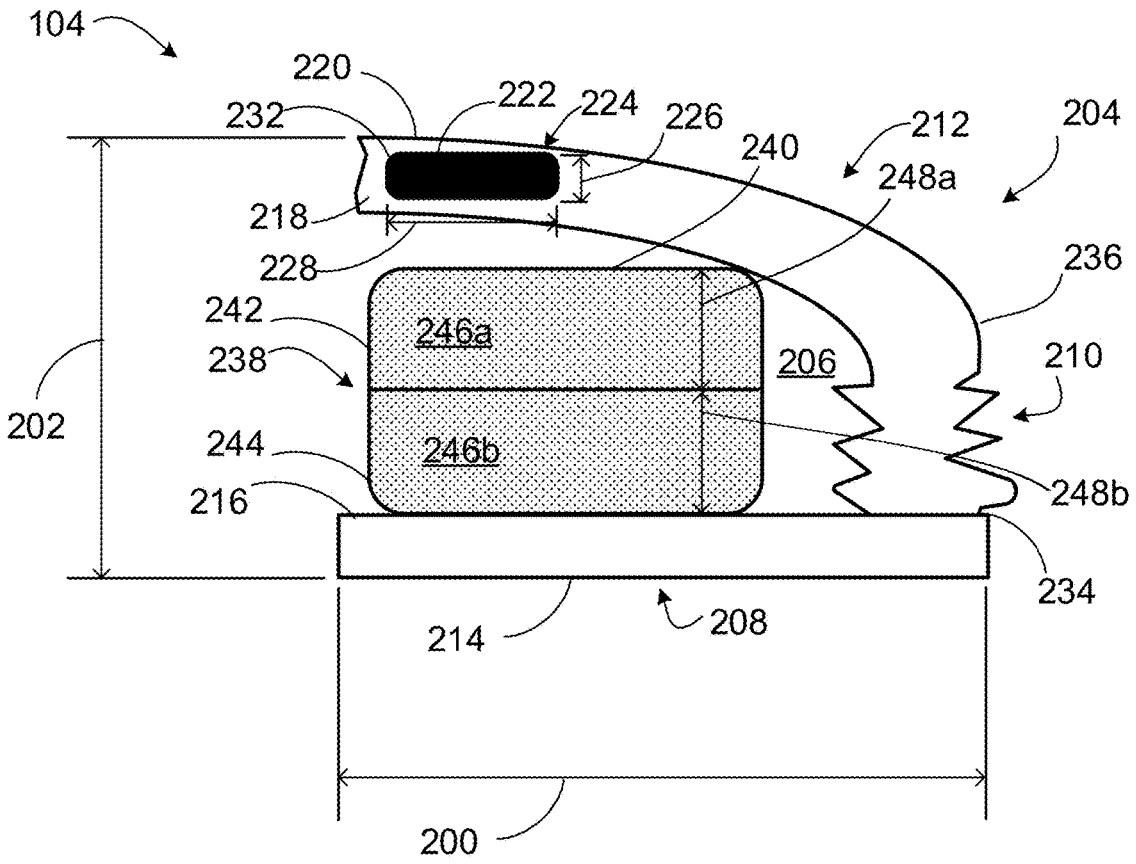
FIG. 2 is a cross section view of the gasket of FIG. 1.
Figure 3:
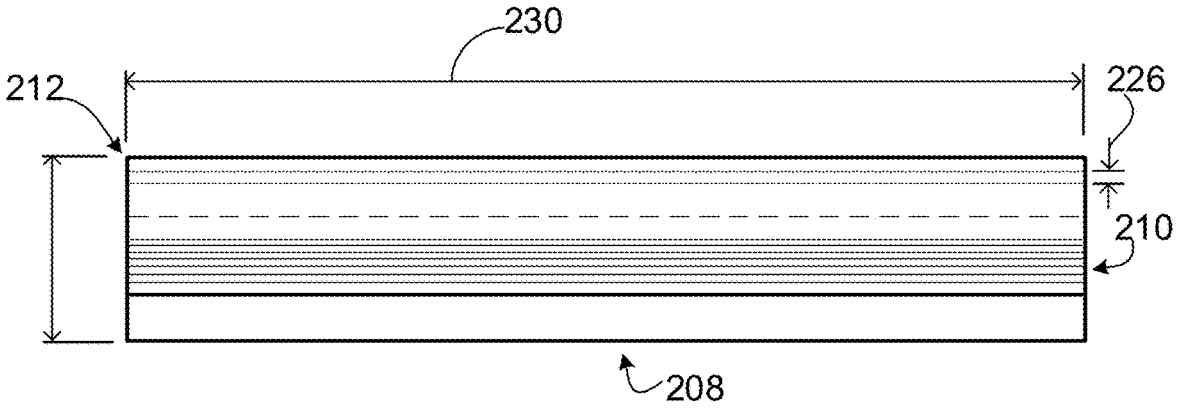
FIG. 3 is a schematic side view of the gasket of FIG. 1.

FIG. 2 is a cross section view A-A of the gasket 104 of FIG. 1. FIG. 3 is a schematic side view of the gasket 104 of FIG. 1. Referring to FIGS. 1-3, the gasket 104 has a width 200 corresponding to a gasket 104 engagement area between the gasket 104 and the inner surface 126 of the display case door 102. The gasket 104 has a height 202. The height 202 corresponds to the distance the gasket 104 extends from the inner surface 126 of the display case door 102.

Referring to FIG. 2, the gasket 104 has a peripheral body 204 which defines a cavity 206. The peripheral body 204 has first portion 208, a second portion 212, and a third portion 210. The first portion 208 is coupled to the third portion 210. The second portion 212 is coupled to the third portion 210. The peripheral body 204 can be a rubber, a synthetic material such as polyvinyl chloride, or other materials with similar pliability and adjustability properties.

The first portion 208 is substantially flat. The first portion 208 has a first surface 214 and a second surface 216. Referring to FIGS. 1 and 2, the first surface 214 of the first portion 208 is coupled to the inner surface 126 of the display case door 102. In some cases, the first portion 208 includes a coupler (not shown) to mechanically couple the first portion 208 to the inner surface 126 of the display case door 102. For example, the coupler can be a locking body shaped like an arrow that snaps into the display case door 102.

The second portion 212 is arranged on an opposite side of the cavity 206 to the first portion 208. The second portion 212 is arm-like, similar to a cantilever beam coupled to and extending from the third portion 210. The second portion 212 has a first surface 218 defining the cavity 206 and facing the first portion 208. The second portion 212 has a second surface 220 opposite the first surface 218.

The second portion 212 has a magnet 222 to optionally magnetically couple the gasket 104 to the cabinet frame 106. The second portion 212 articulates about the third portion 210 as the magnet 222 approaches the cabinet frame 106. As shown in FIG. 2, the second portion 212 fully encloses the magnet 222. In some cases, not shown, the second portion 212 partially encloses magnet 222, that is, the magnet 222 is open to the first surface 218 and the cavity 206. Alternatively or in addition the magnet 22 can be open to the second surface 220.

As shown in FIGS. 2-3, the magnet 222 has a magnet cross section 224. Generally, the magnet cross section 224 is rectangular shaped. The magnet 222 can have rounded corners 232. However, the magnet 222 can have a circular, oval, trapezoidal, or other geometric or irregular shaped magnet cross section 224. The magnet 222 has a height 226, a width 228, and a length 230 (shown in FIG. 3). The height 226 and the width 228 of the magnet 222 are substantially constant along the length 230 of the magnet 222. Alternative embodiments of the magnet 222 are described in reference to FIGS. 4A-4B.

Referring to FIGS. 1-3, the gasket 104 includes the third portion 210 disposed between the first portion 208 and the second portion 212 to compress when the door 102 is closed against the cabinet frame 106. The third portion 210 is coupled to the first portion 208 on a first end 234 and to the second portion 212 on a second end 236. As shown in FIG. 2, the third portion 210 can be accordion shaped, bellows shaped, or S-shaped.

Figure 9:
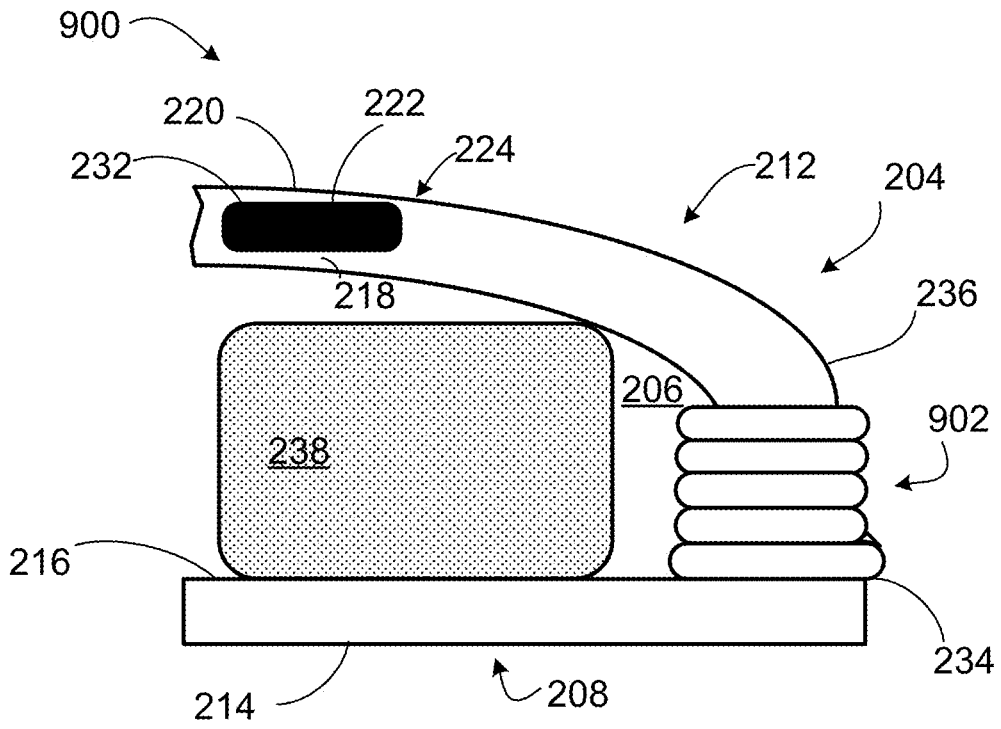
FIG. 9 is a schematic side view of a sixth example gasket.

FIG. 9 is a schematic side view of a sixth example gasket 900. The gasket 900 is generally similar to the gaskets described herein. The gasket 900 includes a second portion 902 generally similar to the third portions described herein. The second portion 902 is spring shaped.

As the second surface 220 of the second portion 212 of the gasket 104 approaches and contacts the cabinet frame 106, the second portion 212 moves toward the cabinet frame 106 in response to a magnetic attraction between the cabinet frame 106 and the magnet 222. As the second portion 212 moves, the third portion 210 expands or articulates as the second end 236 moves relative to the first end 234. As the door 102 continues to close (moves towards the cabinet frame 106), the second portion 212 and the door 102 compress the third portion 210, slowing the movement of the door 102 relative to the cabinet frame 106.

The gasket 104 includes a compressible material 238, also referred to as the compressible foam 238 positioned in, and extending along the length 230 of the cavity 206. As the door 102 closes (moves towards the cabinet frame 106), the second portion 212 and the door 102 compress the second portion 212, slowing the movement of the door 102 relative to the cabinet frame 106. The slowed door 102 continues to move toward the cabinet frame 106. The first surface 218 of the second portion 212 contacts a top surface 240 of the compressible foam 238. The door 102 continues to move toward the cabinet frame 106 (that is, shut) at a slower rate than previously as the compressible foam 238 compresses in the cavity 206.

The compressible foam 238 has the same length 230 as the length 230 of the gasket 104. The compressible foam 238 has a cross section 242. The cross section 242 of the compressible foam 238, as shown in FIG. 2, is generally rectangular with rounded corners 244. Alternatively, the cross section 242 of the compressible foam 238 can be circular, square, triangular, trapezoidal, accordion, or other geometric shape. The compressible foam 238 fills a portion of the cavity 206 corresponding to the cross section 242. In some cases, the cross section 242 fills a majority of the cavity 206.

The compressible foam 238 can be a rubber, a plastic, a fluid, or a gas. A compressibility of the compressible foam 238 can vary along the length 230 of the compressible foam 238. For example, material properties of the rubber or the plastic can be changed along the length 230.

In some cases, the compressible foam 238 has a first portion 246*a* and a second portion 246*b* coupled to the first portion 246*a*. The first portion 246*a* has a height 248*a* and the second portion 246*a* has a height 248*b*. In some cases, the height 248*a* of the first portion equals the height 248*b* of the second portion 246*b*. In some cases, the height 248*a* of the first portion is greater than the height 248*b* of the second portion 246*b*. In some cases, the height 248*a* of the first portion is less than the height 248*b* of the second portion 246*b*. The first portion 246*a* can be a first foam with a first compressibility and the second portion 246*b* can be a second foam with a second compressibility. The first portion 246*a* can be the first foam and the second portion 246*b* can be a first rubber or a first plastic. The first portion 246*a* and the second portion 246*b* can be one or more combinations of foam, rubber, and plastic. Combining layers and differing heights 248*a*, 248*b* of the first portion 246*a* and second portion 246*b* can increase or decrease the compressibility of the compressible foam 238.

Figure 4:
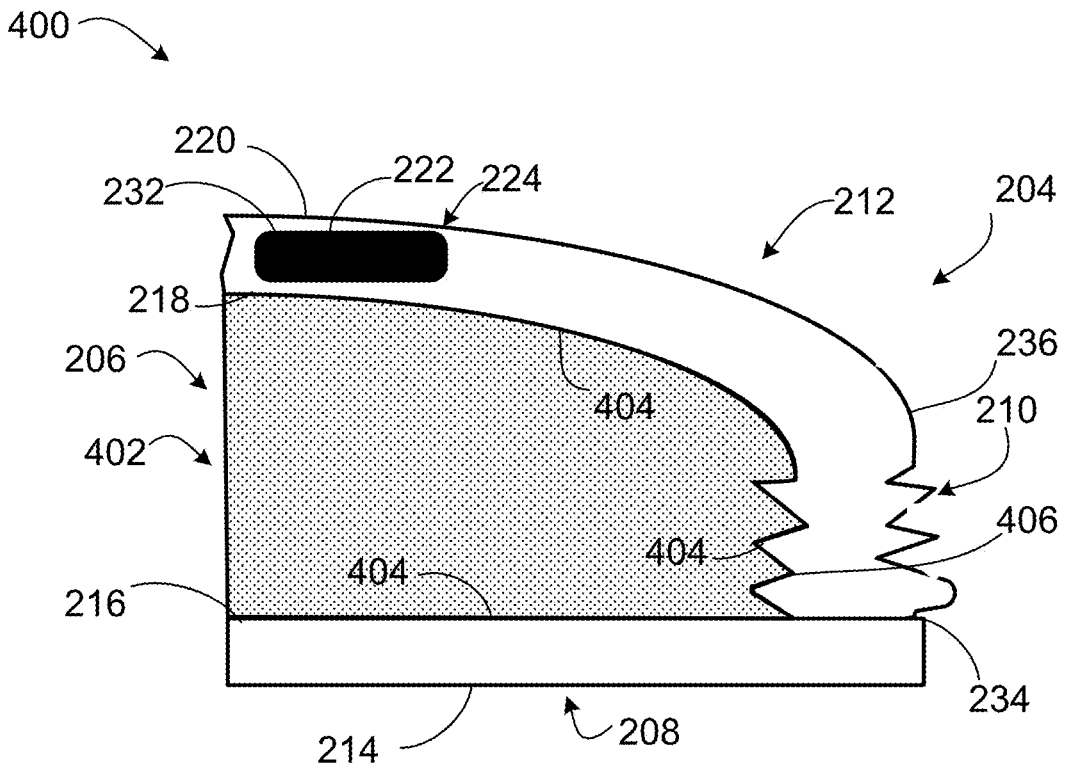
FIG. 4 is a cross section view of another example gasket.

FIG. 4 is a cross section view of another example gasket 400. Referring to FIG. 4, the gasket 400 is generally similar to the gasket 104 previously described in reference to FIGS. 1-3. The gasket 400 has the peripheral body 204 with the first portion 208, the second portion 212, and the third portion 210 which define the cavity 206. The gasket 400 includes a compressible foam 402 positioned in, and extending along the length 230 (shown in FIG. 3) of the cavity 206. The compressible foam 402 fills the cavity 206. In other words, the compressible foam 402 has an outer surface 404 in contact with the second surface 216 of the first portion 208, the first surface 218 of the second portion 212, and an inner surface 406 of the third portion 210.

Figure 5:
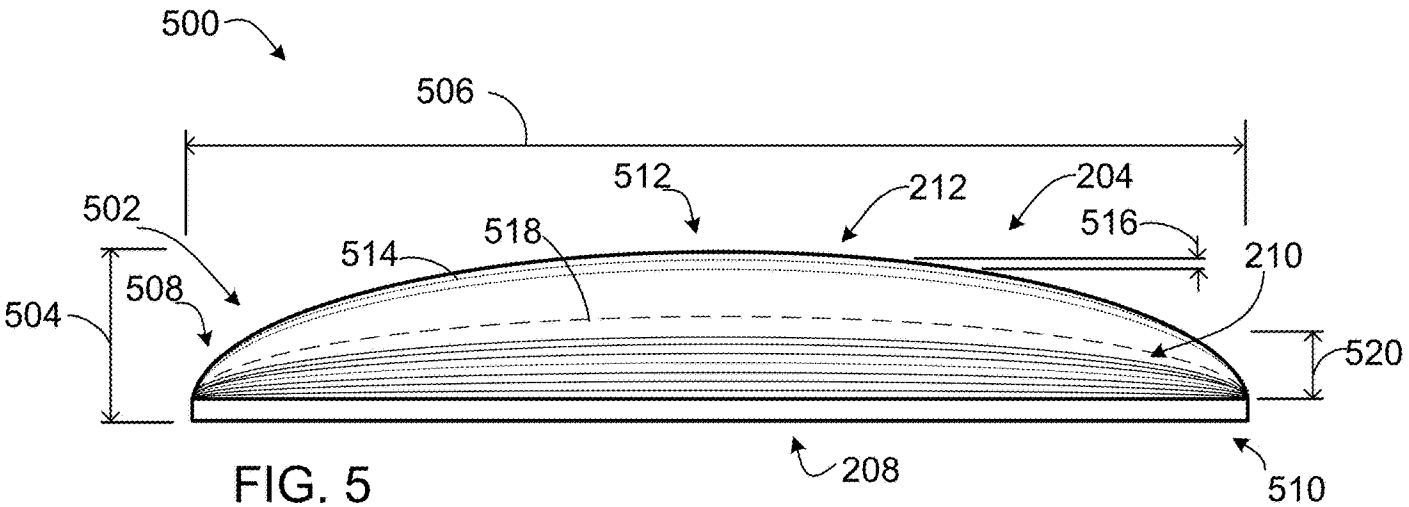
FIG. 5 is a schematic side view of a third example gasket.

FIG. 5 is a schematic side view of a third example gasket 500. Referring to FIG. 5, the gasket 500 has a varying cross section 502. The gasket 500 is generally similar to the gaskets previously described. The gasket 500 has the peripheral body 204 with the first portion 208, the second portion 212, and the third portion 210. The gasket 500 has a height 504 and a length 506. The height 504 of the gasket 500 varies along the length 506. The height 504 is less on a first end 508 and a second end 510 of the gasket 500 than in a middle portion 512 of the gasket 500. The height 504 increases from a first value at the first end 508 to a value greater than the first value at the middle portion 512. The height 504 decreases from the value at middle portion 512 to a value less than the middle portion 512 at the second end 510. The value of the height 504 at the second end 510 can be less than, equal to, or more than the value of the height 504 at the first end 508. The height 504 can increase or decrease linearly or exponentially.

The gasket 500 has a magnet 514, generally similar to the gaskets previously described. The magnet 514 extends along the length 506 of the gasket 500. The magnet 514 has a height 516. The height 516 of the magnet 514 varies along the length 506 of the gasket 500. The height 516 is less on the first end 508 and the second end 510 of the gasket 500 than in a middle portion 512 of the magnet 514. The height 516 of the magnet 514 increases from a first value at the first end 508 to a value greater than the first value at the middle portion 512. The height 516 decreases from the value at middle portion 512 to a value less than the middle portion 512 at the second end 510. The value of the height 516 at the second end 510 can be less than, equal to, or more than the value of the height 516 at the first end 508. The height 516 can increase or decrease linearly or exponentially.

The gasket 500 has a compressible foam 518, generally similar to the compressible foams previously described. The compressible foam 518 extends along the length 506 of the gasket 500. The compressible foam 518 has a height 520. The height 520 of the compressible foam 518 varies along the length 506 of the gasket 500. The height 520 is less on the first end 508 and the second end 510 of the gasket 500 than in a middle portion 512 of the compressible foam 518. The height 520 of the compressible foam 518 increases from a first value at the first end 508 to a value greater than the first value at the middle portion 512. The height 520 decreases from the value at middle portion 512 to a value less than the middle portion 512 at the second end 510. The value of the height 520 at the second end 510 can be less than, equal to, or more than the value of the height 520 at the first end 508. The height 520 can increase or decrease linearly or exponentially. Variations in the gasket height (between height 504 and height 520) are exaggerated in the figures for illustrative purposes, but in practice such variations may only be a small percentage of the overall height 504.

Figure 6:
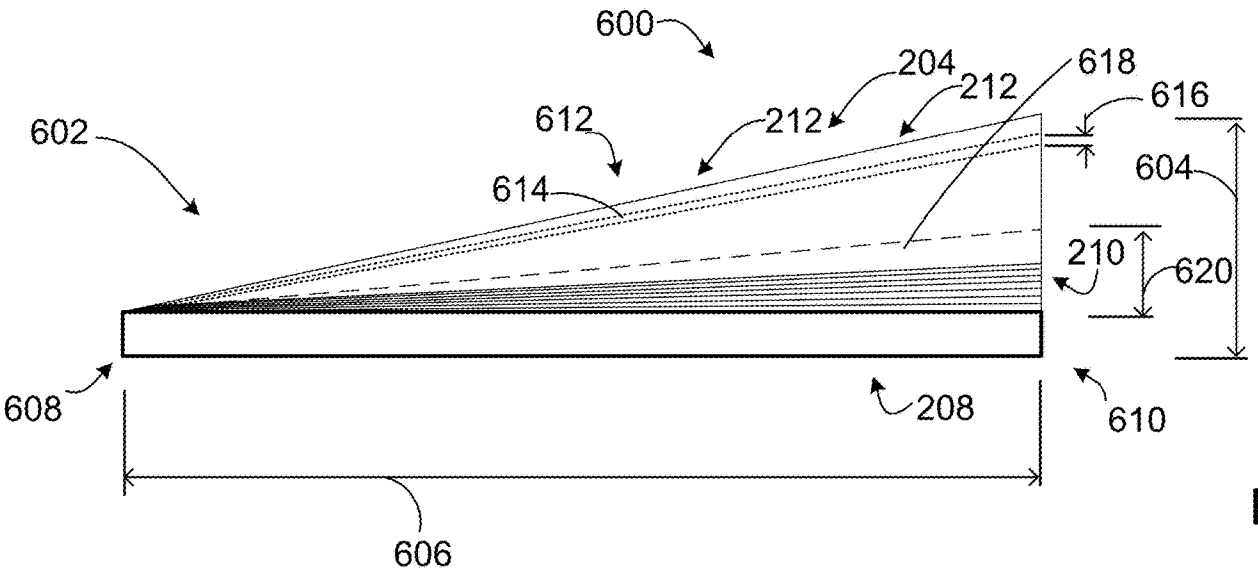
FIG. 6 is a schematic side view of a fourth example gasket.

FIG. 6 is a schematic side view of a fourth example gasket 600. Referring to FIG. 6, the gasket 600 has a varying cross section 602. The gasket 600 is generally similar to the gaskets previously described. The gasket 600 has a height 604 and a length 606. The height 604 of the gasket 600 varies along the length 606. The height 604 is less on a first end 608 of the gasket 600 than in a middle portion 612 of the gasket 600. The height 604 increases from a first value at the first end 608 to a value greater than the first value at the middle portion 612. The height 604 continues to increase from the value at middle portion 612 to a value greater than the middle portion 612 at the second end 610. The value of the height 604 at the second end 610 is greater than the value of the height 604 at the first end 608. The height 604 can increase linearly or exponentially. Variations in the gasket height (between height 604 and height 620) are exaggerated in the figures for illustrative purposes, but in practice such variations may only be a small percentage of the overall height 604.

The gasket 600 has a magnet 614, generally similar to the gaskets previously described. The magnet 614 extends along the length 606 of the gasket 600. The magnet 614 has a height 616. The height 616 of the magnet 614 varies along the length 606 of the gasket 600. The height 616 is less on the first end 608 and a middle portion 612 than and the second end 610 of the magnet 614. The height 616 of the magnet 614 increases from a first value at the first end 608 to a value greater than the first value at the middle portion 612. The height 616 continues to increase from the value at middle portion 612 to a value greater than the middle portion 612 at the second end 610. The value of the height 616 at the second end 610 can be equal to or greater than the value of the height 616 at the middle portion 612. The height 616 can increase linearly or exponentially.

The gasket 600 has a compressible foam 618, generally similar to the compressible foams previously described. The compressible foam 618 extends along the length 606 of the gasket 600. The compressible foam 618 has a height 620. The height 620 of the compressible foam 618 varies along the length 606 of the gasket 600. The height 620 is less on the first end 608 than in a middle portion 612 and the second end 610 of the compressible foam 618. The height 620 of the compressible foam 618 increases from a first value at the first end 608 to a value greater than the first value at the middle portion 612. The height 620 continues to increase from the value at middle portion 612 to a value greater than the middle portion 612 at the second end 610. The value of the height 620 at the second end 610 can be equal to or greater than the value of the height 620 at the first end 608. The height 620 can increase linearly or exponentially.

Figure 7:
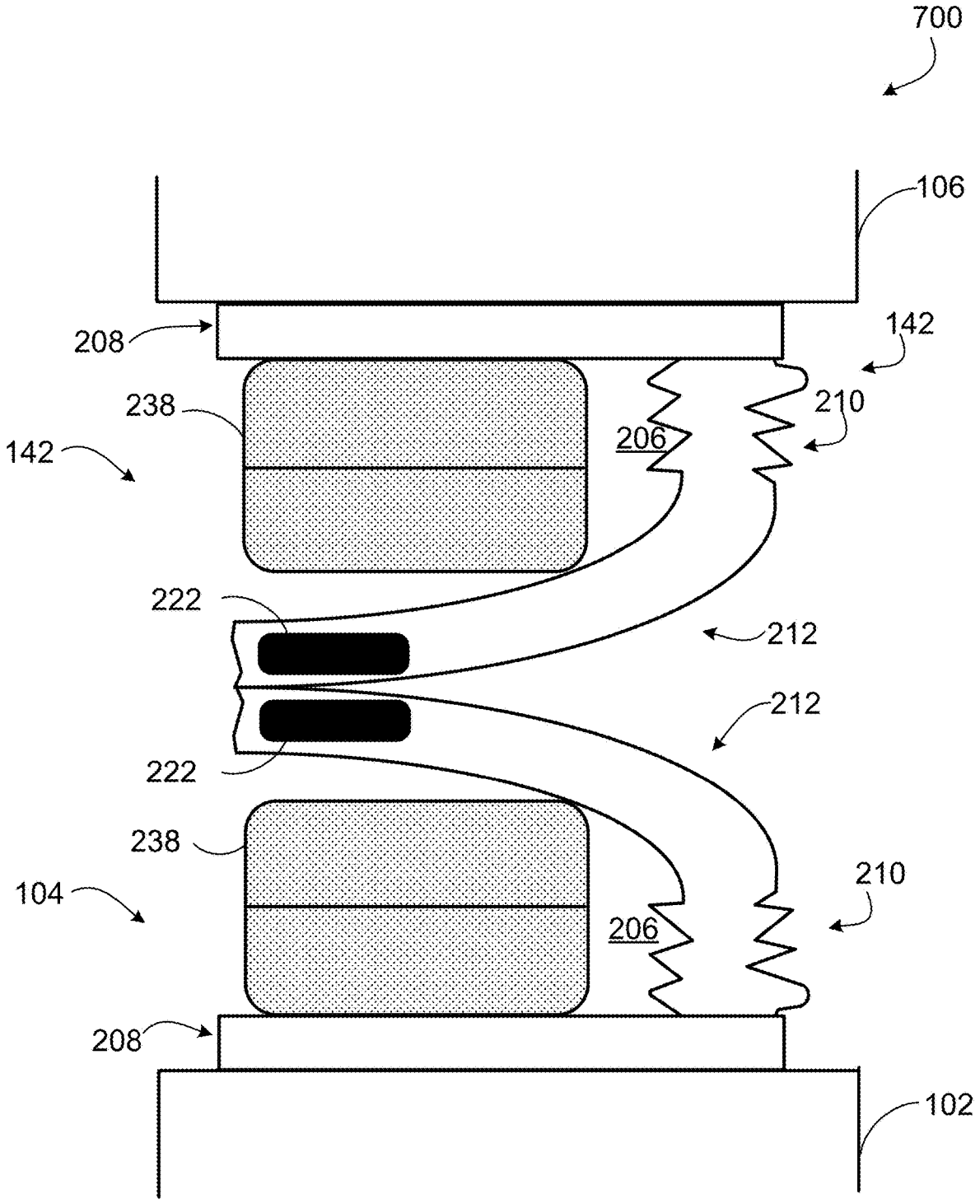
FIG. 7 is schematic view of a gasket assembly on the display case of FIG. 1.

FIG. 7 is schematic view of a gasket assembly 700 of the display case 100 of FIG. 1. Referring to FIGS. 1-7, the display case 100 can include a second gasket 142 substantially similar to one or more of the gaskets previously described coupled to the cabinet frame 106. The second gasket 142 includes a second peripheral body 204 with another first portion 208 (a fourth portion), another second portion 212 (a fifth portion), and another third portion 210 (a sixth portion) which define another (a second) cavity 206. The second gasket 142 includes a second compressible foam 238 in the second cavity 206. Another magnet 222 is positioned in the second portion 212 (the fifth portion). The magnets 222 are positioned to magnetically couple to each other.

As the display case door 102 moves toward the cabinet frame 106, the respective magnets 222 in each of the gasket 104 and 142 move toward each other by an attractive magnetic force, articulating the second portions 212 about the third portions 210. The second portions 212 contact each other. The display case door 102 continues to close as the third portions 210 pull the second portions 212 toward the respective first portions 208. The compressive foams 238 are contacted by the second portions 212, compressing and slowing a rate of movement of the display case door 102.

Figure 8:
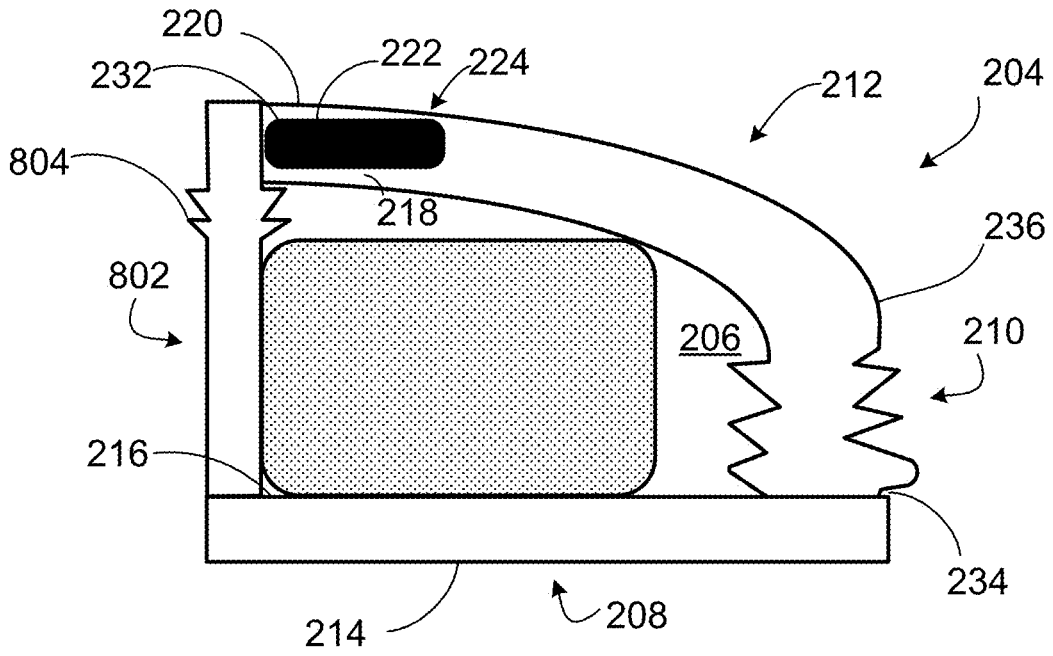
FIG. 8 is a schematic side view of a fifth example gasket.

FIG. 8 is a schematic side view of a fifth example gasket 800. The gasket 800 is generally similar to the gaskets previously described. The gasket 800 peripheral body 204 includes a fourth portion 802 coupled to the first portion 208 and the second portion 212 opposite the third portion 210. The fourth portion 802 is coupled between the second surface 216 of the first portion 208 and the first surface 218 of the second portion 212 to enclose the compressible foam 238 in the cavity 206. In this arrangement, the gasket 800 peripheral body 204 wraps completely around the compressible foam 238. In some cases, the fourth portion 802 includes a fifth portion 804. The fifth portion 804 is substantially similar to the third portion 210 previously described.

Referring to FIG. 1, the gasket 104 can be positioned around the entire inner surface 126 of the display case door 102. In some cases, gasket 104 is only positioned on a portion of the inner surface 126 of the display case door 102. For example, in one implementation the gasket 104 is only positioned the handle side 118. Alternatively, the gasket 104 can be positioned on the top side 132, the handle 116 side, and the bottom side 134.

In another implementation, referring to FIGS. 1-7, the gasket 104 and the compressible material 238 are arranged as a door soft-close device. The gasket 104 has the peripheral body 204 defining the cavity 206. The peripheral body 206 has a region which compresses responsive to a force on the gasket 104. The region can be the cavity 206. The compressible material 238 is positioned in, and extending along a length 230 of the cavity 206.

The peripheral body 204 can be manufactured from rubber or plastic by stamping, extruding, punching, molding, pressing, ejecting, forming, and casting. The compressible foam 238 can be manufactured from rubber or plastic by stamping, extruding, punching, molding, pressing, ejecting, forming, and casting. The compressible foam 238 is then placed in the cavity 206 of the peripheral body 204. The compressible foam 238 can be coupled or fastened to the second surface 216 of the first portion 208. For example, an adhesive, mechanical joints, or interlocking joints can adhere the compressible foam 238 to the second surface 216 of the first portion 208. Alternatively or in addition, the compressible foam 238 can be injected into the cavity 206 to fill a portion of the cavity 206 (as shown in FIG. 2) or the entire cavity 206 (as shown in FIG. 4).

The gasket 104 can be coupled to the inner surface 126 of the display case door 102. For example, the display case door can include a groove (not shown) in which an extended portion (not shown) of the gasket 104 can be positioned. For example, the gasket 104 can be coupled to the inner surface 126 of the display case door 102 by an adhesive (not shown).

Referring to FIG. 1, the display case 100 can include multiple sensors 146 in communication with the controller 148. The sensors 146 sense the position of the gasket 104. For example, the sensors 146 can sense the position of the gasket 104 relative to a sealing surface on the cabinet frame 106 which allows the controller 148 to determine whether the gasket is fully sealed or not. For example, the sensors 146 be magnetic proximity switches, pressure switches, limit switches, or string pot sensors. In some implementations, the sensors 146 provide a binary indication of whether the door is open or closed. In some implementations, the sensors 146 provide a voltage or current level indicating the size of a gap between the gasket 146 and a sealing surface. In some implementations, the sensors 146 can include an acceleration sensor to detect an acceleration of the gasket 104. For example, the acceleration sensor can detect the acceleration of the gasket 104 of the display case door 102 as the display case door 102 moves relative to the cabinet frame 106. For example, the acceleration sensor can detect the acceleration of a portion of the gasket 104 as the gasket 104 expands or compresses responsive to the display case door 102 moving away from or toward the cabinet frame 106.

The sensors 146 can be positioned on the display case door 102 or coupled to the cabinet frame 106. For example, the sensors 146 can be positioned inside the cabinet frame 106 the gasket 104, or internally or partially internal to the cabinet frame 106, to sense the position of the gasket relative to the cabinet frame 106. In some cases, the sensors 146 can be positioned in or interior to the gasket 104 or the second gasket 142, in such implementations. When multiple gaskets, such as the second gasket 142 are used together with the gasket 104, the sensors 146 can sense the position of the gasket 104 relative to the second gasket 142.

The sensors 146 detect the position of the gasket 104. For example, the sensors 146 can detect when display case door 102 is closed, that is, the gasket 104 is contacting a sealing surface of the cabinet frame 106. In some cases, when the display case door 102 is closed, the gasket 104 has fully sealed against the cabinet frame 106. For example, the sensors 146 can detect when the display case door 102 is partially closed or partially open, that is, when the a portion of the gasket 104 is contacting the cabinet frame 106, but another portion of the gasket 104 is spaced apart from the cabinet frame 106, allowing an exchange of air between the a volume 110 of cooled air at an internal temperature lower than an outer environment 112 with air at ambient temperature. For example, the sensors 146 can detect when the display case door 102 is fully open.

The sensors 146 can transmit a signal representing the position of the gasket. For example, the sensors 146 can be wired directly to the controller 148 or can transmit signals wirelessly to the controller 148. The controller 148 receives the signal representing the position of the gasket and determines the status of the gasket seal. For example, the controller 148 can compare the position of the gasket as indicated by the sensor data to an expected position of the gasket to determine whether or not the gasket 104 is fully sealed to the cabinet frame 106 (or whether to gaskets are sealed together in the dual gasket implementation). In response to determining that the gasket 104 is not fully sealed, the controller can control an operation of the display case, e.g., to complete the seal or alert users to the unsealed door. For example, if the display case 100 is equipped with an automatic closing mechanism, such as a motorized or hydraulic hinge, the controller 148 can operate such hinges 108 to close the door or to open and re-close the door 102. As another example, the controller 148 can operate the display case 100 to generate an alarm such as an audible or visual alarm, or alert a user in some other manner that the display door 102 has not sealed properly. In some implementations, the controller 148 can delay taking any action for a threshold period of time, e.g., to confirm that the door 102 is not opened purposefully. For example, upon determining that the gasket 104 is unsealed, the controller 148 can delay attempting to seal the door and/or issuing an alert for a threshold period of 30-200 seconds.

In some implementations, the sensors 146 provide a binary indication of whether the door is open or closed. In some implementations, the sensors 146 can be used to determine an angle of the display case door 102 relative to the cabinet frame 106, that is, how far the display case door 102 is open. In some cases, a position and/or time the display case door 102 is open can indicate whether items 114 are being re-stocked. For example, the controller 148 can count the number of times, when, and/or how far the display case door 102 is opened.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

What is claimed is:

1. A display case door comprising:
- a gasket comprising a peripheral body defining a cavity, the peripheral body comprising:
  - a first portion that is substantially flat and coupled to a surface of the display case door;
  - a second portion arranged on an opposite side of the cavity to the first portion, the second portion comprising a magnet; and
  - a third portion disposed between the first portion and the second portion, the third portion configured to compress when the display case door is closed against a display case cabinet frame; and
- a compressible foam positioned in, and extending along a length of the cavity, wherein a height of the compressible foam varies along the length, wherein the height of the compressible foam is less on a first end of the gasket and a second end of the gasket than in a middle portion of the gasket.

2. The display case door of claim 1, wherein the magnet is configured to contact the second portion of the gasket to at least one of the display case door, the display case cabinet frame, or a second display case door gasket.

3. The display case door of claim 1, wherein the gasket is a first gasket and the magnet is a first magnet, the display case door further comprises a second gasket comprising a second peripheral body defining a second cavity, the second peripheral body comprising:
- a fourth portion that is substantially flat and coupled to a surface of the display case cabinet frame;
- a fifth portion arranged on an opposite side of the second cavity to the fourth portion, the fifth portion comprising a second magnet;
- a sixth portion disposed between the fourth portion and the fifth portion, the sixth portion configured to compress when the display case door is closed against the display case cabinet frame; and
- a second compressible foam positioned in, and extending along a second length of the second cavity.

4. The display case door of claim 3, wherein the first magnet is positioned to couple to the second magnet.

5. The display case door of claim 1, wherein a cross section of the compressible foam is at least one of a rectangular shape, a circular shape, a square shape, or a triangular shape.

6. The display case door of claim 1, wherein a cross section of the compressible foam varies along a length of the compressible foam.

7. The display case door of claim 1, wherein the compressible foam comprises a first portion and a second portion.

8. The display case door of claim 1, wherein a compressibility of the compressible foam varies along a length of the compressible foam.

9. The display case door of claim 1, wherein the third portion is one of spring shaped or accordion shaped.

10. The display case door of claim 1, wherein the compressible foam completely fills the cavity.

11. The display case door of claim 1, wherein the compressible foam fills a majority of a volume within the cavity.

12. The display case door of claim 1, wherein the compressible foam fills a portion of a volume within the cavity.

13. The display case door of claim 1, wherein the peripheral body completely wraps around the compressible foam.

14. A display case door comprising:

a gasket comprising a peripheral body defining a cavity, the peripheral body comprising:

a first portion that is substantially flat and coupled to a surface of the display case door;

a second portion arranged on an opposite side of the cavity to the first portion, the second portion comprising a magnet, wherein a height of the magnet is less on a first end of the gasket and a second end of the gasket than in a middle portion of the gasket; and a third portion disposed between the first portion and the second portion, the third portion configured to compress when the display case door is closed against a cabinet frame; and a compressible foam positioned in, and extending along a length of the cavity, wherein a height of the compressible foam varies along the length.

15. A display case door comprising:

a gasket comprising a peripheral body defining a cavity, the peripheral body comprising:

a first portion that is substantially flat and coupled to a surface of the display case door;

a second portion arranged on an opposite side of the cavity to the first portion, the second portion comprising a magnet, wherein a height of the magnet increases from a first end of the gasket to a second end of the gasket; and a third portion disposed between the first portion and the second portion, the third portion configured to compress when the display case door is closed against a cabinet frame; and a compressible foam positioned in, and extending along a length of the cavity, wherein a height of the compressible foam varies along the length.

16. The display case door of claim 15, wherein the peripheral body completely wraps around the compressible foam.

17. The display case door of claim 15, wherein the height of the compressible foam increases from a first end of the gasket to a second end of the gasket.

18. A display case door comprising:

a gasket comprising a peripheral body defining a cavity, the peripheral body comprising:

a first portion that is substantially flat and coupled to a surface of the display case door;

a second portion arranged on an opposite side of the cavity to the first portion, the second portion comprising a magnet; and a third portion disposed between the first portion and the second portion, the third portion configured to compress when the display case door is closed against a cabinet frame; and a compressible foam positioned in, and extending along a length of the cavity, wherein a height of the compressible foam varies along the length, wherein a height of the magnet varies along the length of the gasket at a same rate as the height of the compressible foam varies along the length of the gasket.

* * * * *